US007108523B2

(12) United States Patent
Hartman

(10) Patent No.: US 7,108,523 B2
(45) Date of Patent: Sep. 19, 2006

(54) PLUGGABLE TRANSCEIVER WITH COVER RESILIENT MEMBER

(75) Inventor: William Hartman, Broomfield, CO (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 10/819,633

(22) Filed: Apr. 7, 2004

(65) Prior Publication Data

US 2005/0227518 A1 Oct. 13, 2005

(51) Int. Cl.
*H01R 13/62* (2006.01)

(52) U.S. Cl. ..... 439/157

(58) Field of Classification Search ..... 439/157, 439/372, 638, 76.1, 152, 160, 923
See application file for complete search history.

(56) References Cited

U.S. PATENT DOCUMENTS 6,430,053 B1 8/2002 Peterson et al.
6,439,918 B1 8/2002 Togami et al.
6,517,382 B1 2/2003 Flickinger et al.
6,533,470 B1 3/2003 Ahrens
6,533,603 B1 3/2003 Togami
6,538,901 B1 3/2003 Hung
6,570,768 B1 5/2003 Medina
6,612,858 B1 9/2003 Stockhaus
6,890,206 B1 * 5/2005 Distad et al. ..... 439/372
6,908,323 B1 * 6/2005 Ice ..... 439/160
6,942,395 B1 * 9/2005 Chuan et al. ..... 385/53
2002/0150344 A1 10/2002 Chiu et al.
2003/0044129 A1 3/2003 Ahrens et al.

OTHER PUBLICATIONS

Agilent Technologies et al., "Small Form-Factor Pluggable (SFP) Transceiver MultiSource Agreement (MSA)," Cooperation Agreement for Small Form-Factor Pluggable Transceivers, pp. 1-38, (Sep. 14, 2000).

* cited by examiner

*Primary Examiner*—J. F. Duverne
(74) *Attorney, Agent, or Firm*—Workman Nydegger

(57) ABSTRACT

Embodiments of the present invention are described in a pluggable transceiver. The pluggable transceiver comprises a housing, a handle and a cover. The cover comprises a resilient member, wherein the cover is configured to receive the housing and the resilient member is adapted to retain the cover in place and to be moved by the handle to release the cover.

18 Claims, 5 Drawing Sheets

PLUGGABLE TRANSCEIVER WITH COVER RESILIENT MEMBER

BACKGROUND

Fiber optic transceivers facilitate bi-directional data transmissions between electronic devices and optical data links in fiber optic systems. Each transceiver includes a photo detector for converting optically encoded data received from an optical data link to electrically encoded data readable by a host electronic device, and a laser diode for converting electrically encoded data from the host electronic device into optically encode data that are transmitted through an optical data link. Each transceiver is mounted onto a circuit board assembly of the host electronic device and, typically, packaged such that it occupies as little circuit board surface area as possible.

Small Form-factor Pluggable (SFP) transceivers are one type of transceiver having standardized physical dimensions and performance characteristics that are defined in the "Cooperation Agreement for Small Form-factor Pluggable Transceivers", as executed on Sep. 14, 2000 (herein "the Cooperation Agreement"), which is incorporated herein in its entirety. The Cooperation Agreement is part of an SFP transceiver multi-source agreement for establishing internationally compatible sources of pluggable fiber optic transceivers in support of established standards for fiber optic systems. Specifically, the Cooperation Agreement sets forth transceiver package dimensions, cage and electrical connector specifications, host circuit board layouts, electrical interface specifications and front panel bezel requirements that are followed by each party.

A typical optical transceiver assembly includes a cage, a female electrical connector and a pluggable transceiver. The cage and the female electrical connector are mounted on a host printed circuit board. The pluggable transceiver is inserted into the cage to electrically couple the pluggable transceiver to the female connector. An optional faceplate or bezel is mounted over the end of the transceiver assembly.

The pluggable transceiver includes transceiver electronics mounted in an elongated transceiver housing that includes one or more receptacles for receiving optical connectors, such as duplex LC, MT-RJ or SC connectors. Mounted within the transceiver housing is a housing printed circuit board that supports the transceiver electronics. The transceiver electronics process data signals from a photo detector and supply data signals to a laser diode. Extending from the back of the housing printed circuit board is a male connector card including contacts that meet with corresponding contacts of the female electrical connector as the pluggable transceiver is inserted into the cage.

The pluggable transceiver is latched into the cage to prevent the pluggable transceiver from inadvertently sliding away from the female electrical connector. Typically, the cage includes a transceiver latch that defines a latch opening and the housing includes a housing catch pin or boss. As the pluggable transceiver is inserted into the cage, the housing catch pin engages the transceiver latch to bend the transceiver latch. The latch opening receives the housing catch pin to secure the pluggable transceiver in the cage. To remove the pluggable transceiver from the cage, a manual force is applied to bend the transceiver latch and release the housing catch pin from the latch opening.

It is often difficult to manipulate the cage transceiver latch in highly populated arrangements, thereby making it difficult to remove the pluggable transceiver from the cage. Also, latch mechanisms for releasing the housing catch pin from the latch opening, typically, include many components for forcing the flexible cage transceiver latch away from the housing catch pin.

SUMMARY

Embodiments of the present invention are described in a pluggable transceiver. The pluggable transceiver comprises a housing, a handle and a cover. The cover comprises a resilient member, wherein the cover is configured to receive the housing and the resilient member is adapted to retain the cover in place and to be moved by the handle to release the cover.

DETAILED DESCRIPTION

Figure 1:
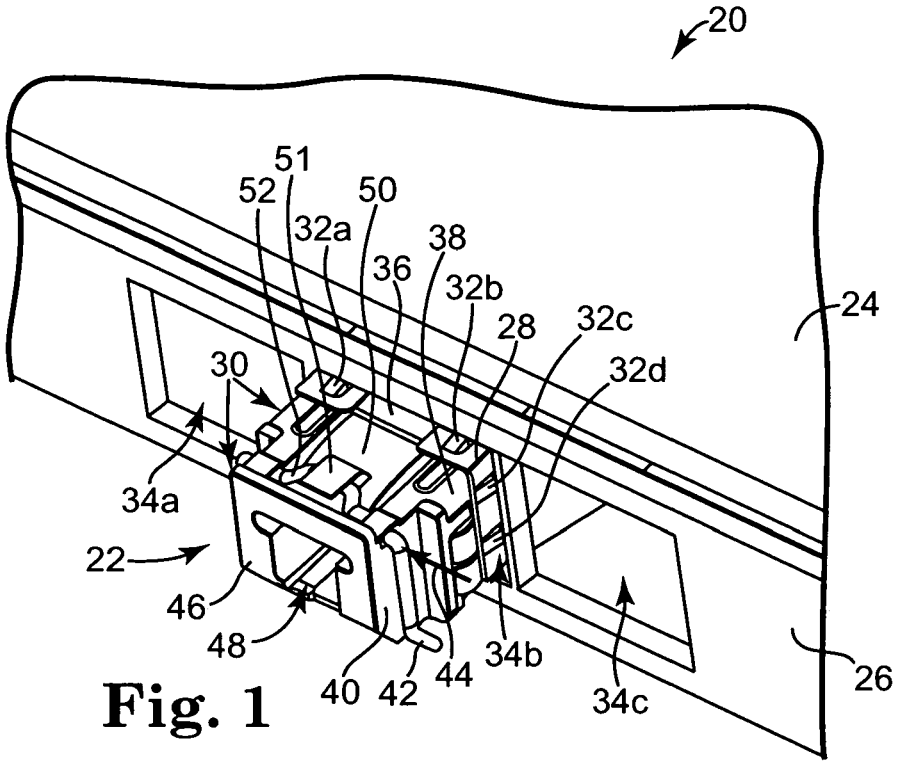
FIG. 1 is a diagram illustrating an electronic system including a pluggable transceiver assembly, a host printed circuit board and a faceplate.

FIG. 1 is a diagram illustrating an electronic system 20 including a pluggable transceiver assembly 22, a host printed circuit board 24 and a faceplate 26. The pluggable transceiver assembly 22 includes a cage 28 and a pluggable transceiver 30. The cage 28 is mounted to host printed circuit board 24, such as by soldering cage 28 to host printed circuit board 24 or force fitting cage feet into holes in host printed circuit board 24. The faceplate 26 includes faceplate holes or slots, indicated at 34*a*–34*c*. Each faceplate slot 34*a*–34*c* is configured to receive a cage 28. The cage 28 is slid into faceplate slot 34*b* and held in place by cage fingers 32*a*–32*d*.

The cage 28 conforms to the Cooperation Agreement, previously incorporated by reference, and defines a pluggable transceiver slot that receives pluggable transceiver 30. The cage 28 includes a transceiver latch, indicated at 36, at the front end of cage 28. Also, the cage 28 includes a leaf spring at the back end of cage 28. The leaf spring engages pluggable transceiver 30 to bias pluggable transceiver 30 toward the front end of cage 28. A female connector (not shown) is mounted to host printed circuit board 24 at the back end of cage 28. In one embodiment, the female connector is soldered to host printed circuit board 24 behind cage 28.

The pluggable transceiver 30 includes a cover 38, a housing 40 and a handle 42. The housing 40 is received by cover 38 and secured inside cover 38. The handle 42 is situated in a groove in housing 40 and retained in the housing groove by cover 38. The handle 42 rotates around an axis 44 of handle 42 situated in the groove of housing 40.

The housing 40 includes optical transceiver electronics that are mounted in housing 40 and a housing front portion 46 that defines a receptacle 48 for receiving an optical connector. In one embodiment, front portion 46 defines a single receptacle 48 for receiving a single optical connector. In other embodiments, the front portion of the housing defines two or more receptacles, such as one receptacle for receiving an optical connector to receive optical data and another receptacle for receiving an optical connector to transmit optical data. The optical connectors can be any suitable connectors, such as duplex LC, MT-RJ or SC connectors.

A housing printed circuit board is mounted in housing 40 and supports the transceiver electronics mounted in housing 40. The transceiver electronics process data signals received from a photo detector. Also, the transceiver electronics supplies data signals to a laser diode that transmits optical data. Extending from the back end of the housing printed circuit board is a male connector including contacts that mate with corresponding contacts of the female connector mounted at the back end of cage 28 on host printed circuit board 24. The male connector contacts mate with the corresponding contacts of the female connector as the pluggable transceiver 30 is inserted into cage 28.

The cover 38 includes a resilient member 50. The resilient member 50 engages cage transceiver latch 36 as pluggable transceiver 30 is inserted into cage 28. The resilient member 50 and transceiver latch 36 cooperate to latch pluggable transceiver 30 into cage 28.

In one embodiment, resilient member 50 can be moved into a first state and a second state to engage and disengage pluggable transceiver 30 and cage 28. The resilient member 50 includes a handle retention member 51 and handle 42 includes a cam portion, indicated at 52. The cam portion 52 engages resilient member 50 and retention member 51 to move or force resilient member 50 into the first and second states. As handle 42 is rotated away from housing 40, cam portion 52 forces resilient member 50 into a concave state, e.g., the first state, to move resilient member 50 away from transceiver latch 36 and disengage the pluggable transceiver 30 from cage 28. The leaf spring at the back of cage 28 pushes pluggable transceiver 30 forward in cage 28. The pluggable transceiver 30 is further removed from cage 28 by pulling handle 42 to slide pluggable transceiver 30 out of cage 28. As handle 42 is rotated back toward housing 40, cam portion 52 forces resilient member 50 into a convex state, e.g., the second state, to engage transceiver latch 36 and cage 28.

Figure 2:
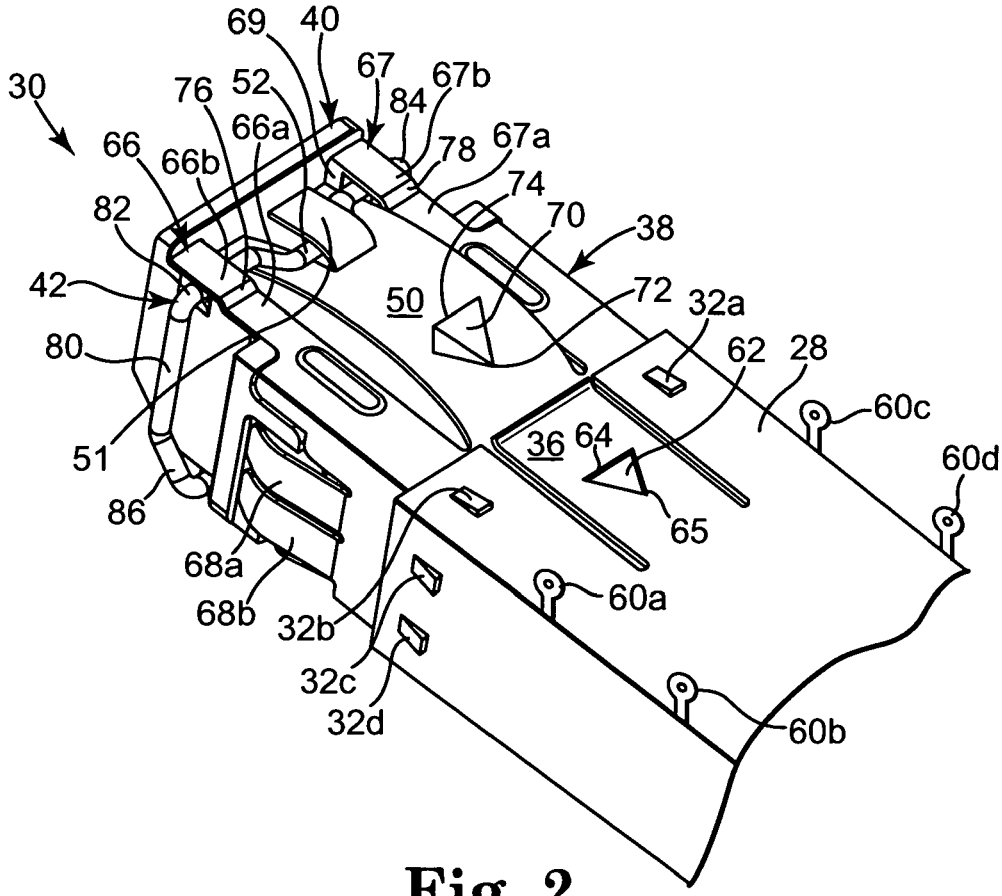
FIG. 2 is a diagram illustrating a pluggable transceiver partially inserted into a cage.

FIG. 2 is a diagram illustrating pluggable transceiver 30 partially inserted in cage 28. The host printed circuit board 24 and faceplate 26 have been removed for clarity. The cage 28 includes transceiver latch 36, cage fingers 32*a*–32*d* and cage feet 60*a*–60*d*. The transceiver latch 36 defines a latch hole or boss hole, indicated at 62. The latch hole 62 is triangular shaped and includes one side 64 that is parallel with the front end of cage 28 and one corner 65 that points toward the back end of cage 28. The cage fingers 32*a*–32*d* are cantilevered springs that retain faceplate 26 on cage 28. The cage feet 60*a*–60*d* are force fit into metal plated holes in host printed circuit board 24 to attach and electrically couple cage 28 to host printed circuit board 24. The cage 28, including cage fingers 32*a*–32*d* and cage feet 60*a*–60*d*, is made of a suitable metal material. In other embodiments, the latch hole 62 can be aligned differently and the latch hole 62 can be another suitable shape.

The pluggable transceiver 30 includes cover 38, housing 40 and handle 42. The cover 38 is situated on each side of housing 40 and includes resilient member 50, cover support members 66 and 67, and insertion leaf springs 68*a* and 68*b*. In addition, cover 38 includes insertion leaf springs, similar to insertion leaf springs 68*a* and 68*b*, on each side of cover 38 except the side of cover 38 that has resilient member 50.

The resilient member 50 includes a catch or boss 70. The boss 70 is situated on resilient member 50 near the middle of resilient member 50. The boss 70 is triangular shaped and sloped from one corner 72 to one side 74 to form an upward sloping ramp. The resilient member 50 is forced into the convex state, illustrated in FIG. 2, to position boss 70 for engaging latch hole 62 in transceiver latch 36. The resilient member 50 is forced into the concave state to move boss 70 away from transceiver latch 36 to disengage pluggable transceiver 30 from cage 28. The resilient member 50 is attached to cover support member 67 at 69 and to cover support member 66.

The cover support members 66 and 67 are situated on each side of resilient member 50. The cover support members 66 and 67 include base portions, indicated at 66*a* and 67*a*, and raised portions, indicated at 66*b* and 67*b*. The base portions 66*a* and 67*a* are connected to the rest of cover 38 and the raised portions 66*b* and 67*b* are each attached at one end to resilient member 50. The cover support members 66 and 67 are bent at 76 and 78 to position raised portions 66*b* and 67*b* on handle 42. Also, resilient member 50 includes handle retention member 51 positioned on handle 42.

The handle 42 includes cam portion 52, axis portions 82 and 84, lever arm portion 80 and angled handle portion 86. Lever arm portions, such as lever arm portion 80, are situated on each side of housing 40 and connected to cam portion 52 through axis portions 82 and 84. Also, lever arm portions 80 are connected together through angled handle portion 86. The angled handle portion 86 is angled from lever arm portions 80 toward cover 38 and tucked under housing 40. The axis portions 82 and 84 are situated in grooves in housing 40 and retained in the grooves of housing 40 by raised portions 66*b* and 67*b* of cover support members 66 and 67. In one embodiment, raised portions 66*b* and 67*b* fit into slots in housing 40 to retain handle 42 between housing 40 and cover 38. Also, in one embodiment, housing 40 is made of plastic and handle 42 is made of a metal wire that is bent to form handle 42 including cam portion 52 and lever arm portions 80.

In operation, pluggable transceiver 30 is inserted into cage 28 and boss 70 engages transceiver latch 36. The insertion leaf springs, such as insertion leaf springs 68*a* and 68*b*, on three sides of cover 38 bias boss 70 against transceiver latch 36. The transceiver latch 36 slides up ramped boss 70 from corner 72 to side 74. As transceiver latch 36 slides up boss 70, resilient member 50 is forced toward housing 40 and transceiver latch 36 is biased away from cover 38. As pluggable transceiver 30 is further inserted into cage 28, boss 70 is received in latch hole 62. One side 64 of latch hole 62 is situated next to one side 74 of boss 70 to latch pluggable transceiver 30 into cage 28.

To remove pluggable transceiver 30 from cage 28, angled handle portion 86 is pulled away from cover 38 and out of the tucked position. In response to moving angled handle portion 86 away from cover 38, handle 42 rotates at axis 44 and lever arm portions 80 force cam portion 52 against resilient member 50. The cam portion 52 forces resilient member 50 toward housing 40 and snaps resilient member 50 into the concave state. Snapping resilient member 50 into the concave state, moves boss 70 away from transceiver latch 36. The boss 70 is moved away from transceiver latch 36 to disengage boss 70 from latch hole 62 and release pluggable transceiver 30 from cage 28. The leaf spring at the back end of cage 28 pushes pluggable transceiver 30 forward in cage 28 and pluggable transceiver 30 can be slid out of cage 28.

Figure 3:
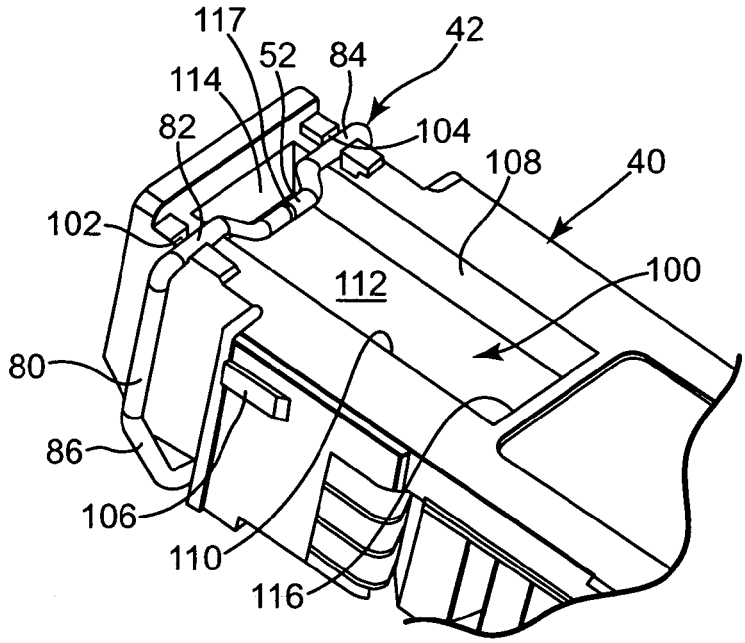
FIG. 3 is a diagram illustrating a housing and a handle of a pluggable transceiver.

FIG. 3 is a diagram illustrating housing 40 and handle 42 of pluggable transceiver 30. The cover 38 has been removed from pluggable transceiver 30 to reveal handle 42 situated in housing 40. The housing 40 includes a housing slot 100, housing grooves 102 and 104, and a housing pin segment 106. The housing slot 100 is defined by housing slot sidewalls 108 and 110, front wall 114, back wall 116 and housing slot floor 112. The axis portions 82 and 84 of handle 42 are situated in housing grooves 102 and 104. The axis portion 82 is positioned in housing groove 102 and the axis portion 84 is positioned in housing groove 104. The cam portion 52 of handle 42 is situated over housing slot 100. In one embodiment, cam portion 52 is split at 117. The handle 42 can be divided at split 117 to insert handle 42 in cover 38.

The resilient member 50 of cover 38 is forced into housing slot 100 by cam portion 52 as angled handle portion 86 is moved away from cover 38. The housing slot 100 includes a length, width and depth that are suitably sized for receiving resilient member 50 and releasing boss 70 from latch hole 62. The housing pin segment 106 aligns housing 40 in cover 38.

Figure 4:
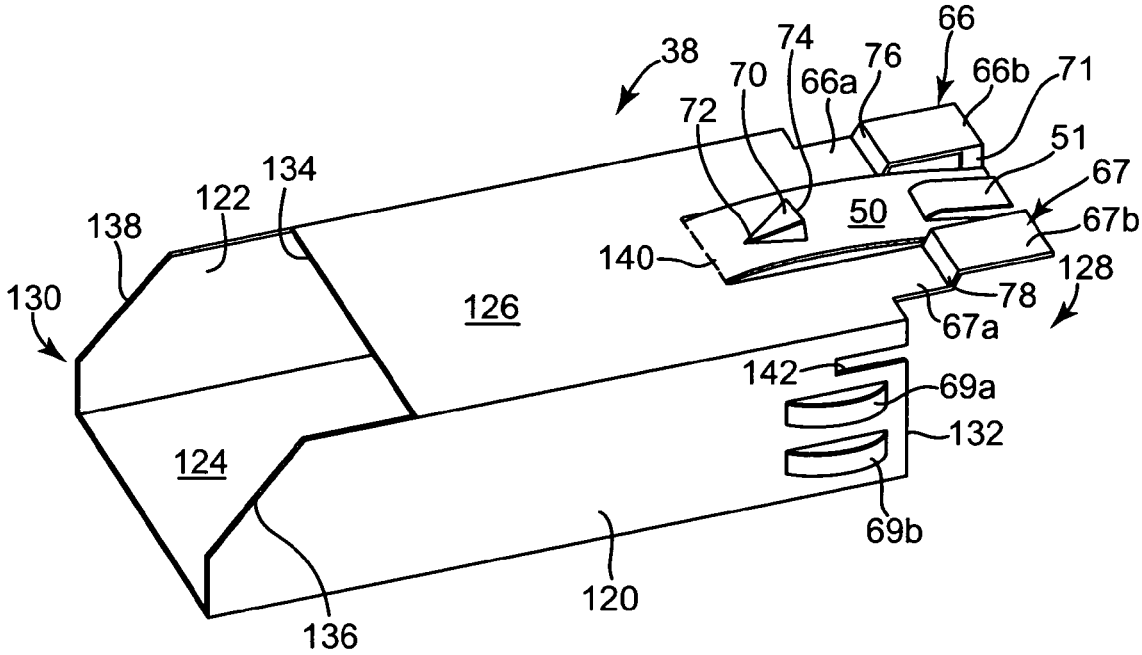
FIG. 4 is a diagram illustrating a cover of a pluggable transceiver.

FIG. 4 is a diagram illustrating cover 38 of pluggable transceiver 30. The cover 38 includes sidewalls 120 and 122, top wall 124 and bottom wall 126. The walls 120, 122, 124 and 126 form a rectangular shape with a front end at 128 and a back end at 130. The sidewalls 120 and 122 extend from back end 130 toward front end 128 and up to front sidewall edge 132. The top wall 124 extends between sidewalls 120 and 122 and from back end 130 toward front end 128, up to front sidewall edge 132. The bottom wall 126 extends from front end 128 toward back end 130 and up to back bottom wall edge 134. The sidewalls 120 and 122 are angled at 136 and 138, between back end 130 and back bottom wall edge 134. In addition, sidewalls 120 and 122 include sidewall notches 142 that receive housing pin segments 106 to align housing 40 in cover 38.

The top wall 124, sidewalls 120 and 122 and bottom wall 126 define an opening at the back end 130 of cover 38. The housing 40 and housing printed circuit board are secured in cover 38 with male connector contacts attached to the housing printed circuit board protruding through the opening at the back end 130 of cover 38. The male connector contacts engage corresponding female connector contacts mounted behind cage 28 on host printed circuit board 24 as pluggable transceiver 30 is inserted into cage 28.

The cover 38 includes resilient member 50, cover support members 66 and 67, and insertion leaf springs 69*a* and 69*b*. The resilient member 50 is part of bottom wall 126 and attached to the rest of bottom wall 126 at 140. The resilient member 50 includes boss 70 that is triangular shaped and ramped upward from one corner 72 to one side at 74. The one side at 74 operates as a catch for latching boss 70 in latch hole 62 of transceiver latch 36.

The cover support members 66 and 67 include base portions 66*a* and 67*a*, and raised portions 66*b* and 67*b*. The cover support member 66 includes base portion 66*a* connected to and part of bottom wall 126. The cover support member 66 is bent at 76 between base portion 66*a* and raised portion 66*b* to position raised portion 66*b* in a different plane than base portion 66*a*. The cover support member 67 includes base portion 67*a* connected to and part of bottom wall 126. The cover support member 67 is bent at 78 between base portion 67*a* and raised portion 67*b* to position raised portion 67*b* in a different plane than base portion 67*a*. The raised portions 66*b* and 67*b* retain handle 42 in grooves 102 and 104 of housing 40.

Raised portions 66*b* and 67*b* are connected to resilient member 50. Raised portion 66*b* is connected to resilient member 50 at 71 and raised portion 67*b* is connected to resilient member 50 at 69, as shown in FIG. 2. The axis portion 82 of handle 42 is positioned between resilient member 50 and raised portion 66*b*, and axis portion 84 of handle 42 is positioned between resilient member 50 and raised portions 67*b*. Cam portion 52 is positioned between resilient member 50 and retention member 51. Cam portion 52 is positioned to be forced against resilient member 50 to move resilient member 50 into the concave state, and cam portion 52 is positioned to be forced against retention member 51 to move resilient member 50 into the convex state.

The insertion leaf springs 69*a* and 69*b* on sidewall 120 are similar to insertion leaf springs 68*a* and 68*b* that are on opposing sidewall 122. The insertion leaf spring 68 and 69 and insertion leaf springs on top wall 124 bias boss 70 against transceiver latch 36 and align cover 38 in cage 28 as cover 38 and pluggable transceiver 30 is inserted into cage 28.

Figure 5:
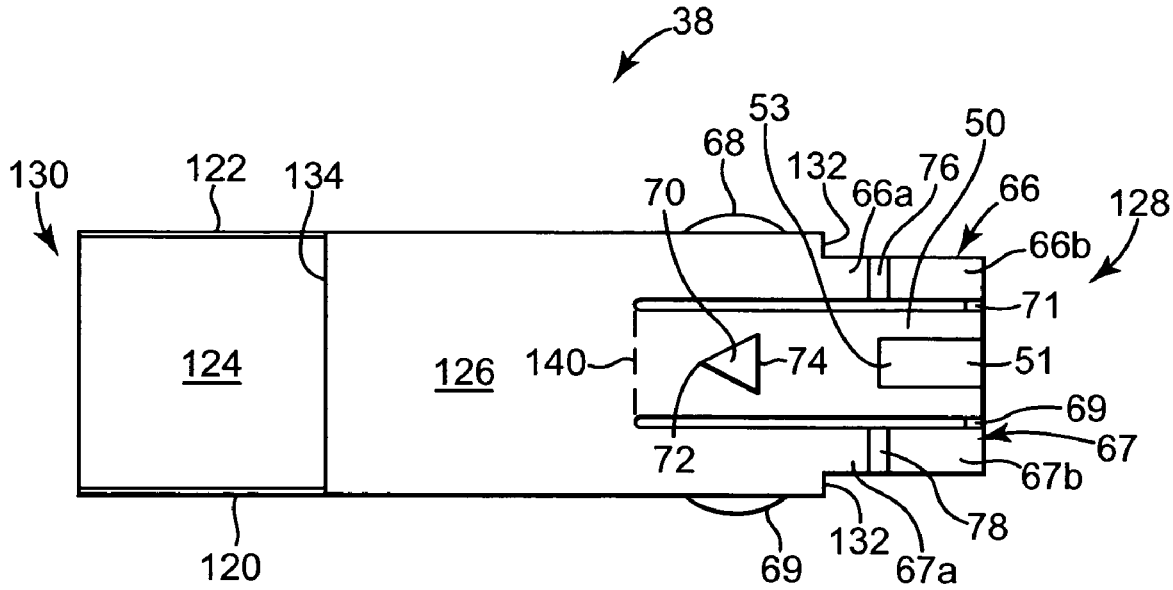
FIG. 5 is a diagram illustrating a bottom view of a cover.

FIG. 5 is a diagram illustrating a bottom view of cover 38. The cover 38 includes bottom wall 126, top wall 124 and sidewalls 120 and 122. The bottom wall 126 extends from the front end at 128 toward the back end at 130 and up to back bottom wall edge 134. The top wall 124 extends from the back end at 130 toward the front end at 128 and up to front sidewall edge 132. Sidewalls 120 and 122 extend from the back end at 130 toward the front end at 128 and up to front sidewall edge 132. Insertion leaf springs 68 and 69 are attached to sidewalls 120 and 122. Insertion leaf springs 68 are attached to sidewall 122 and arch away from sidewall 122. Insertion leaf springs 69 are attached to sidewall 120 and arch away from sidewall 120.

The bottom wall 126 includes resilient member 50 situated between cover support members 66 and 67. The resilient member 50 extends from front end 128 to the line at 140, where it is connected to the rest of bottom wall 126. The resilient member 50 includes boss 70 that is triangular shaped and situated with one side 74 parallel with front end 128 and one corner 72 pointing toward back end 130. Also, resilient member 50 includes retention member 51 that is bent at 53 to be situated in a different plane than the rest of resilient member 50. The resilient member 50 is connected to raised portion 66*b* at 71 and to raised portion 67*b* at 69.

The cover support members 66 and 67 extend from the front end at 128 to the front sidewall edge 132. The cover support member 66 is bent at 76 between base portion 66*a* and raised portion 66*b*. The cover support member 67 is bent at 78 between base portion 67*a* and raised portion 67*b*. In one embodiment, cover support members 66 and 67 are inserted into slots in housing 40.

Figure 6:
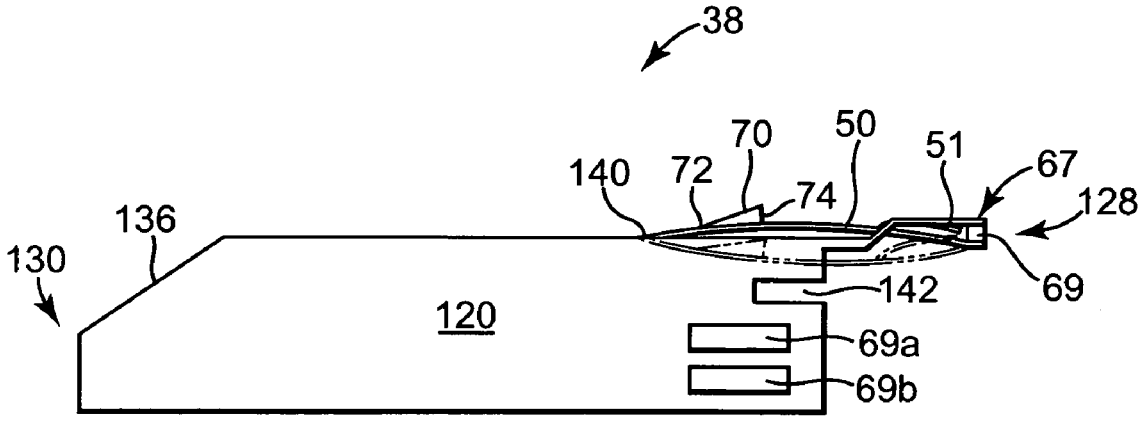
FIG. 6 is a diagram illustrating a side view of a cover.

FIG. 6 is a diagram illustrating a side view of cover 38. The cover 38 includes sidewall 120 that is angled at 136 and insertion leaf springs 69*a* and 69*b*. In addition, sidewall 120 defines sidewall notch 142 that receives housing pin segment 106 to align housing 40 in cover 38.

The resilient member 50 includes boss 70 and retention member 51. The boss 70 is situated on resilient member 50 and protrudes away from resilient member 50. The boss 70 includes side 74 and ramps to corner 72. The resilient member 50 is bowed and connected to cover support member 67 at 69 and to the rest of cover 38 at 140. The cover 38 is made out of metal and resilient member 50 operates as a bowed spring that snaps into two states, the convex state and the concave state, illustrated in dashed lines.

Figure 7:
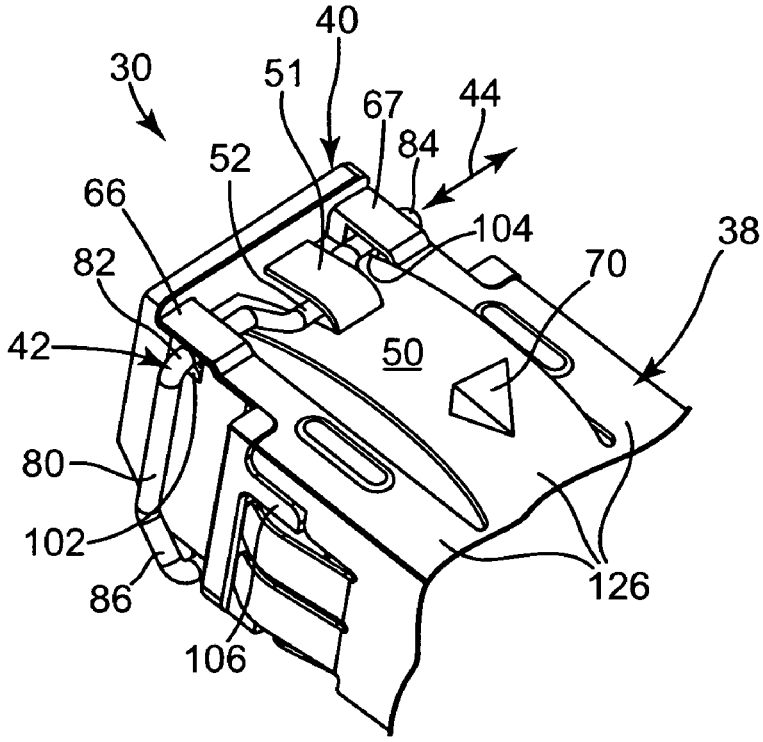
FIG. 7 is a diagram illustrating a handle in the closed or tucked position, next to a cover and a housing of a pluggable transceiver.
Figure 8:
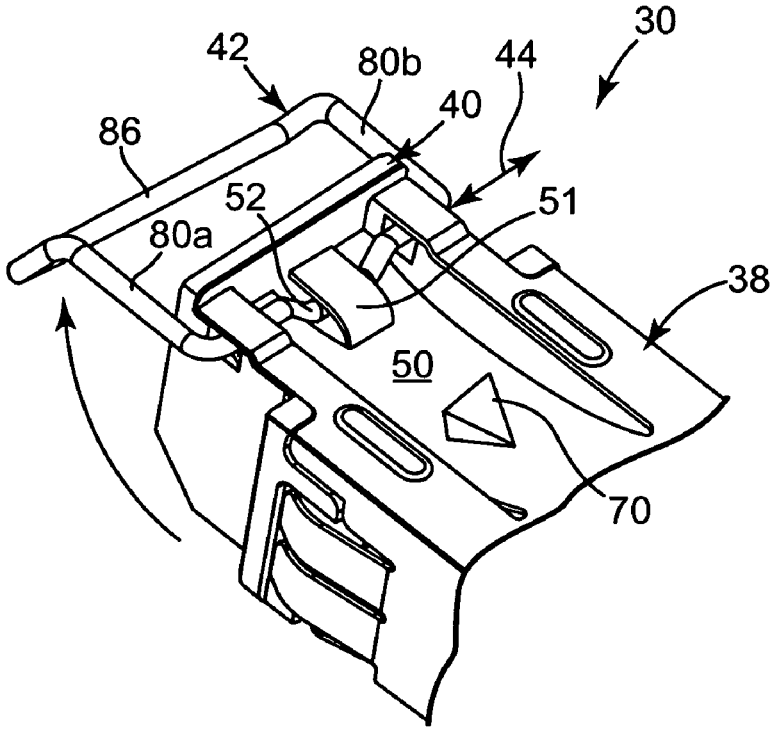
FIG. 8 is a diagram illustrating a handle in the open position for extracting a pluggable transceiver from a cage.
Figure 9:
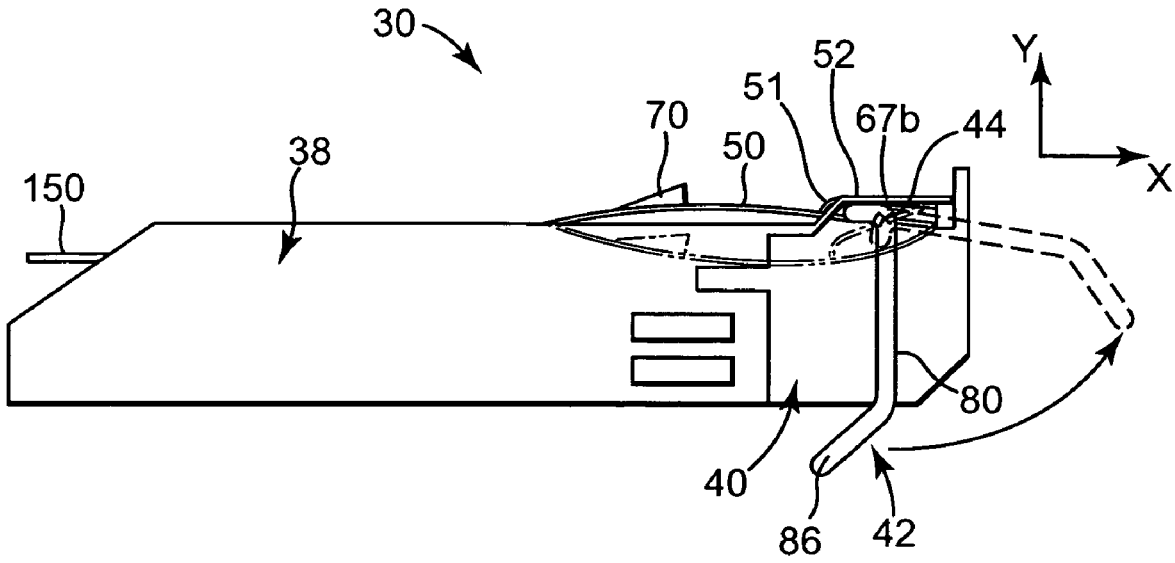
FIG. 9 is a side view diagram illustrating operation of a handle and a resilient member of a pluggable transceiver.

FIGS. 7–9 are diagrams illustrating operation of handle 42 and resilient member 50 for latching/releasing pluggable transceiver 30 to/from cage 28. FIG. 7 is a diagram illustrating handle 42 in the closed or tucked position, next to cover 38 and housing 40. The pluggable transceiver 30 includes housing 40, handle 42 and cover 38. The housing 40 includes housing grooves 102 and 104 and housing pin segments, such as housing pin segment 106, on each side of housing 40. The handle 42 includes cam portion 52, axis portions 82 and 84, lever arm portions 80 and angled handle portion 86. The angled handle portion 86 connects lever arm portions 80 together and is situated next to housing 40 in the closed position. The axis portions 82 and 84 are situated in housing grooves 102 and 104, respectively, and handle 42 rotates in housing grooves 102 and 104 at axis 44. The cam portion 52 is connected between axis portions 82 and 84 and situated between resilient member 50 and retention member 51.

The cover 38 includes cover support members 66 and 67 and resilient member 50. The cover support members 66 and 67 are disposed over axis portions 82 and 84 to retain handle 42 in housing grooves 102 and 104. The housing pin segments 106 of housing 40 are received by sidewall notches 142 in cover 38 and housing 40 is secured in cover 38. The resilient member 50 includes boss 70 and retention member 51. The cam portion 52 is situated between retention member 51 and resilient member 50. As handle 42 is moved into the closed or tucked position, cam portion 52 is forced against retention member 51 and snaps resilient member 50 into the convex state. Boss 70 protrudes above bottom wall 126 of cover 38 to engage latch hole 62. In the closed or tucked position, boss 70 can latch pluggable transceiver 30 into cage 28.

FIG. 8 is a diagram illustrating handle 42 in the open position for extracting pluggable transceiver 30 from cage 28. The angled handle portion 86 is pulled away from housing 40 to move lever arm portions 80 away from cover 38 and housing 40. Handle 42 rotates at axis 44 to force cam portion 52 against resilient member 50. With lever arm portions 80 at a suitable angle, such as between 40 and 60 degrees from housing 40, cam portion 52 snaps resilient member 50 into the concave state and resilient member 50 moves into housing slot 100. Boss 70 moves away from transceiver latch 36 and is released from latch hole 62 of transceiver latch 36 to release pluggable transceiver 30 from cage 28. The leaf spring situated at the back of cage 38 pushes pluggable transceiver 30 toward the front end of cage 28 as boss 70 is released from transceiver latch 36.

The lever arm portions 80*a* and 80*b* rotate to a suitable angle, such as between 80 and 100 degrees from housing 40, as resilient member 50 snaps into the concave state. The pluggable transceiver 30 can be removed from cage 28 by grasping and pulling angled handle portion 86 to remove pluggable transceiver 30 from cage 28. After pluggable transceiver 30 is removed from cage 28, resilient member 50 remains in the concave state until handle 42 is returned to the closed position and cam portion 52 snaps resilient member 50 into the convex state.

FIG. 9 is a side view diagram illustrating operation of handle 42 and resilient member 50 of pluggable transceiver 30. The pluggable transceiver 30 includes housing 40, cover 38 and handle 42. The housing 40 is situated in cover 38 and handle 42 is retained between housing 40 and raised portions 66*b* and 67*b* of cover 38. The handle 42 rotates at axis 44.

In the closed position, resilient member 50 is in the convex position and boss 70 protrudes from pluggable transceiver 30 in the y-direction to engage transceiver latch 36. The latch hole 62 in transceiver latch 36 receives boss 70 to latch pluggable transceiver 30 into cage 28. Male connector contacts, indicated at 150, are electrically coupled to the housing printed circuit board and received by the female connector mounted to host printed circuit board 24.

The handle 42 includes cam portion 52, lever arm portions 80 and angled handle portion 86. In the closed position, lever arm portions 80 are situated next to housing 40 along the y-direction and angled handle portion 86 is tucked next to housing 40.

As angled handle portion 86 is moved out of the tucked position and away from housing 40, indicated in dashed lines, handle 42 rotates about axis 44. The lever arm portions 80 move from being positioned along the y-direction toward being positioned along the x-direction. The cam portion 52 is forced against resilient member 50 to snap resilient member 50 into the concave position. The boss 70 moves away from transceiver latch 36 and out of latch hole 62 to release pluggable transceiver 30 from cage 28. The leaf spring, at the back end of cage 28, pushes pluggable transceiver 30 toward the front end of cage 28. The male contacts at 150 are disengaged from the female contacts mounted to host printed circuit board 24. The handle 42 moves further to the open position and pluggable transceiver 30 can be removed completely by pulling on angled handle portion 86. After pluggable transceiver 30 is removed from cage 28, resilient member 50 remains in the concave state until handle 42 is returned to the closed position and cam portion 52 snaps resilient member 50 into the convex state.

What is claimed is:

1. A pluggable transceiver, comprising:

a housing;

a handle attached to the housing; and a cover within which the housing is partially received, the cover including a resilient member operably disposed with respect to the handle and configured to assume first and second states that correspond with first and second positions, respectively, of the handle, such that when the pluggable transceiver is positioned within a cage, the resilient member is engaged with the cage in the first state and is disengaged from the cage in the second state.

2. The pluggable transceiver of claim 1, wherein the first and second positions of the handle correspond with, respectively, a first deflection of the resilient member and a second deflection of the resilient member.

3. The pluggable transceiver of claim 1, wherein the resilient member comprises a handle retention member with which the handle is engaged.

4. The pluggable transceiver of claim 1, wherein the resilient member includes a boss configured to releasably engage the cage when the resilient member is transceiver is positioned within the cage.

5. The pluggable transceiver of claim 1, wherein the resilient member and handle collectively comprise a cam arrangement by way of which changes in the state of the resilient member are achieved.

6. A pluggable transceiver, comprising:

a handle; and a cover that includes a resilient member having a protruding element configured to selectively engage an opening defined by a cage when the pluggable transceiver is positioned within the cage, wherein the resilient member and the protruding element are configured to move in a predetermined direction in response to motion of the handle relative to the cover.

7. The pluggable transceiver of claim 6, wherein the resilient member has two spaced apart ends and the cover supports the resilient member at the two ends and the resilient member is bowed between the two ends.

8. The pluggable transceiver of claim 6, wherein the resilient member is configured to assume a convex state or a concave state, depending upon the position of the handle.

9. The pluggable transceiver of claim 6, wherein the boss is triangular shaped and ramped upward from one corner of the triangle to one side of the triangle.

10. The pluggable transceiver of claim 6, wherein the pluggable transceiver comprises:

a small form factor pluggable ("SFP") transceiver.

11. A transceiver assembly, comprising:

a cage; and a pluggable transceiver configured to be positioned within the cage, and comprising:

a housing;

a handle attached to the housing; and a cover within which the housing is partially received, the cover including a resilient member operably disposed with respect to the handle and configured to assume first and second states that correspond with first and second positions, respectively, of the handle, such that when the pluggable transceiver is positioned within the cage, the resilient member is engaged with the cage in the first state and is disengaged from the cage in the second state.

12. The transceiver assembly as recited in claim 11, wherein the first and second positions of the handle correspond with, respectively, a first deflection of the resilient member and a second deflection of the resilient member.

13. The transceiver assembly as recited in claim 11, wherein the resilient member comprises a handle retention member with which the handle is engaged.

14. The transceiver assembly as recited in claim 11, wherein the resilient member includes a boss configured to releasably engage the cage when the pluggable transceiver is positioned within the cage.

15. The transceiver assembly as recited in claim 11, wherein the resilient member is configured to assume a convex state or a concave state, depending upon the position of the handle.

16. The transceiver assembly as recited in claim 11, wherein the resilient member and handle collectively comprise a cam arrangement by way of which changes in the state of the resilient member are achieved.

17. The transceiver assembly as recited in claim 11, wherein the resilient member includes a cam surface arranged for contact with the handle.

18. A pluggable transceiver, comprising:

a housing;

a handle attached to the housing; and a cover within which the housing is partially received, the cover including a resilient member that defines a cam surface arranged to contact a cam portion of the handle such that a first deflected state of the resilient member corresponds to a first position of the handle, and a second deflected state of the resilient member corresponds to a second position of the handle.

* * * * *